United States Patent [19]

Nilsson, deceased

[11] Patent Number: 4,525,155

[45] Date of Patent: Jun. 25, 1985

[54] CENTRIFUGAL SEPARATOR AND METHOD OF OPERATING THE SAME

[75] Inventor: Vilgot Nilsson, deceased, late of Hägersten, Sweden, by Mary Nilsson and Goran Nilsson, legal representatives

[73] Assignee: Alfa-Laval Marine and Powering Engineering AB, Tumba, Sweden

[21] Appl. No.: 599,063

[22] Filed: Apr. 11, 1984

[30] Foreign Application Priority Data

Apr. 20, 1983 [SE] Sweden ..... 8302215

[51] Int. Cl.[3] ..... B04B 11/00

[52] U.S. Cl. ..... 494/3; 494/10; 494/37; 494/901

[58] Field of Search ..... 494/1, 2, 3, 10, 11, 494/37, 56, 70, 901

[56] References Cited

U.S. PATENT DOCUMENTS

| | | | |
|---|---|---|---|
| 2,532,792 | 12/1950 | Svensjo | 494/1 |
| 3,396,910 | 8/1968 | Steinacker | 494/3 |
| 3,494,545 | 2/1970 | Nilson | 494/1 |
| 3,593,915 | 7/1971 | Steinacker | 494/3 |
| 3,642,196 | 2/1972 | Nilsson | 494/2 |
| 3,750,940 | 8/1973 | Nilsson | 494/3 |
| 3,752,389 | 8/1973 | Nilsson | 494/3 |
| 3,938,734 | 2/1976 | Wilke | 494/11 |
| 3,976,242 | 8/1976 | Hemfort | 494/3 |
| 4,151,950 | 5/1979 | Gunnewig | 494/2 |
| 4,475,897 | 10/1984 | Bradtmöller | 494/10 |

*Primary Examiner*—Robert W. Jenkins
*Assistant Examiner*—Arthur D. Dahlberg
*Attorney, Agent, or Firm*—Cyrus S. Hapgood

[57] ABSTRACT

A centrifugal separator for separating two liquid components from each other normally has continuously open outlets for both liquid components, an interface layer formed in the separating chamber between the separated liquid components being maintained at a predetermined radial level. The present invention concerns a special arrangement for continuous discharge of the light liquid component but intermittent discharge of the heavy liquid component. For this purpose, a first outlet channel (20) in the centrifuge rotor for the heavy liquid component communicates through a calibrated opening (24) with a stationary second channel (23) outside the rotor, said second channel comprising a shut off valve (31). An equipment (28) is arranged to indicate when an interface layer formed in the separating chamber (8) of the rotor between the separated liquid components has moved radially inwards to a certain level (29). A control unit (34) is arranged on a signal from the indicating equipment (28) to keep the valve (31) open until the desired amount of heavy liquid component has been discharged from the separating chamber (8).

15 Claims, 1 Drawing Figure

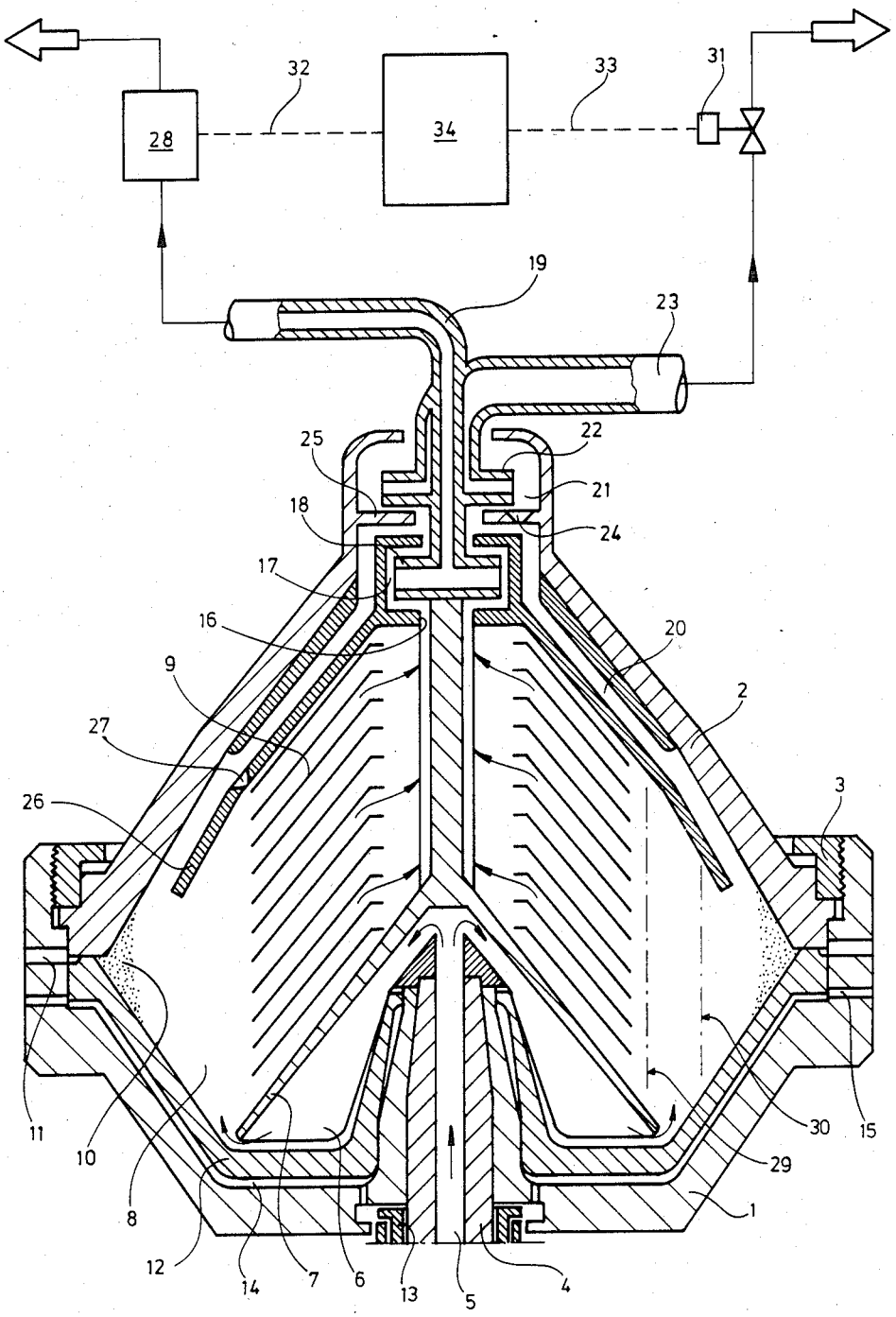
28
32
34
33
31
19
23
25
22
21
18
24
17
16
20
9
2
27
3
26
11
10
8
12
14
7
6
13
5
4
1
29
30
15

CENTRIFUGAL SEPARATOR AND METHOD OF OPERATING THE SAME

The present invention relates to a centrifugal separator the rotor of which has an inlet for a mixture of two liquids to be separated, a first outlet for a separated light liquid component and a second outlet for a separated heavy liquid component, said second outlet comprising a first channel formed in the rotor, one end of which opens in the rotor separating chamber and the other end of which opens into a chamber situated centrally within the rotor, means being arranged for discharge of heavy liquid component from said central chamber, when an interface layer formed in the rotor between the separated liquid components has moved radially inwards to a predetermined level in the rotor, so that separated heavy liquid component is allowed to flow from the rotor separating chamber to said second outlet.

A centrifugal separator of this kind is known by the Swedish Pat. No. 348,121 (corresponding to U.S. Pat. No. 3,752,389). In this known centrifugal separator it is sensed when the inteface layer between heavy liquid component and light liquid component has moved radially inwards in the rotor to a predetermined level somewhat radially inside of the opening of said first channel in the separating chamber, whereupon the outlet for heavy liquid component is opened. After this point of time heavy liquid component separated within the rotor is allowed successively to leave the rotor through said first channel, the interface layer in the rotor between the separated liquid components though being retained at said predetermined level. After a certain time separate outlets at the rotor periphery are opened for discharge of solid particles separated from the liquid mixture supplied to the rotor, said interface layer being moved radially outwards in the rotor past the opening of the first channel in the separating chamber. Simultaneously the above mentioned valve in the outlet for the heavy liquid component is closed, whereupon the described course is repeated.

The previously known centrifugal separator now described was developed to be used specifically on board ships in connection with cleaning of fuel oils from water and solids. It was presumed for the centrifugal separator in question that the fuel oils to be cleaned could have a heavily varying content of water, but that they had substantially the same density.

However, since the described centrifugal separator came into existence the following, among other things, has happened due to changes in the methods of refining crude oil (mineral oil). Firstly, the density of fuel oils available for driving ships has increased substantially in some places. The difference in density between fuel oil and the water to be separated therefrom, thus, has decreased substantially. From having been in 1970 about 0.935 at about 98° C. (normal separating temperature) the density of fuel oils in 1980 often has been about 0.960, whereas the density of water at corresponding temperature is about 0.965. Secondly, the density of fuel oils has varied very much lately between different harbours where ships have to take on board new fuel oil. There are thus differences in density of between 0.935 and 0.960. Also differences in viscosity of the fuel oil have been noticed, which make the problem even worse to clean fuel oils of different kinds by means of a specifically designed centrifugal separator.

At the above mentioned previously known centrifugal separator means are arranged during a longer or shorter time after the outlet for the heavy liquid component has been opened to maintain the interface layer between the separated liquid components, i.e. oil and water, at a predetermined level within the rotor. If these means are constituted by immovable overflow outlets for the oil and water, respectively, from the rotor, this is presuming an unchanged density of the oil and water, respectively, for the maintenance of the interface layer at the predetermined level. Immovable overflow outlets are thus not suitable, if the densities of the oils to be separated varies. On the other hand, if the interface layer is to be maintained at a predetermined radial level within the rotor by sensing of pressure differences in the outlet conduit for water and subsequent control of a valve arranged in this outlet conduit, it is required that the used sensing, control, and valve equipment is sufficiently sensitive for appearing movements of the interface layer in question within the rotor. Such equipment is difficult to obtain, however, in cases where the difference in density between the oil and the water is very small, which makes it impossible in practice in such cases to maintain safely the interface layer between oil and water at a predetermined level in the rotor.

The object of the present invention is to provide a centrifugal separator by means of which separation problems of the above described kind can be solved.

Primarily this is achieved in a centrifugal separator of the initially described kind wherein said central chamber communicates with said channel such that the interface layer in the separating chamber between the separated components will move radially outwards, when heavy liquid component is discharged from said central chamber, a control unit being arranged by actuating said discharge means to stop said discharge of heavy liquid component from the central chamber, when a predetermined amount of heavy liquid component has left the separating chamber through said channel.

In a preferred embodiment of the invention applied on a centrifugal separator comprising a stationary outlet member, for instance a pairing disc, arranged in the central chamber and having a second channel extending from the central chamber out from the rotor to an outlet for the separated heavy liquid component, the said control unit is arranged to open and close a valve in said second channel.

For avoiding the risk of loosing a certain amount of light liquid component together with the heavy liquid component, or for avoiding the necessity of having special means for switching the flow through said channels, when all of the separated liquid component has been discharged from the separating chamber, said control unit preferably is arranged to close the valve in the second channel, when the interface layer has moved radially outwards to a predetermined second level in the rotor, situated radially inside the opening of the first channel in the separating chamber.

A control unit of the kind in question may be designed in different ways. According to a preferred embodiment the outlet for the heavy liquid component has a calibrated outflow opening, means being arranged to keep said valve open a predetermined period of time. This period of time preferably is chosen such, with regard to among other things the size of said calibrated outflow opening, that at the end of the period of time the interface layer in the rotor between the separated liquid components has moved radially outwards to the predetermined second level.

According to a development of the invention the centrifugal separator has a separate connection between the separating chamber and the above mentioned first channel somewhere between the ends of the latter, which connection has less throughflow capacity than the channel itself.

By such a separate connection the function of the described arrangement is substantially improved, for instance in connection with cleaning of fuel oil from water. Thus, firstly, it is achieved that when the interface layer between oil and water moves radially inwards in the rotor past the opening of the first channel in the separating chamber, the separated water can not force oil radially inwards in the channel in an amount such that oil is forced inside the edge of the centrally situated chamber and thereby leak out and deteoriate the space outside the rotor. Instead, part of the oil situated in the channel and displaced by separated water, will flow back to the separating chamber through said connection.

Secondly, it is achieved, when the valve in the second channel arranged outside the rotor is reclosed after having let out a certain amount of water, that the stationary outlet member situated in the central chamber after a short while will be immerged into oil instead of water rotating at the same speed as the rotor. This is because, when the flow of water through the first channel has ceased, oil will flow into this channel through said connection and change place with the water situated in the central chamber. Hereby it is avoided that water remaining in the central chamber is evaporated due to heat development and fills out the space around the rotor. If such evaporation had been allowed to occur, so much water had been developed after some time that the interface layer in the rotor had been moved radially outwards to the level of the opening of said first channel in the separating chamber. Then, at the beginning, fractions of oil would flow into the channel and therethrough to the central chamber, from which these oil fractions would be entrained by evaporated water steam when the water was boiling. A water and oil mist would then be formed which would fill up all the space around the centrifugal separator. Such an undesired effect has been noticed, before the above mentioned separate connection was arranged between the separating chamber and first channel. A corresponding evaporation problem will not be present if only oil is present in the central chamber, since oil has a higher boiling point than water.

The invention will be described in the following reference to the accompanying drawing showing parts of a centrifugal separator designed in accordance with a preferred embodiment of the invention.

The centrifuge rotor in the drawing comprises a lower part 1 and an upper part 2, which parts are clamped together by means of a lock ring 3. The rotor is carried by a drive shaft 4 having a central channel 5 for the supply of a mixture to be separated in the rotor. The mixture is conducted by a distributor 7 provided with entrainment members 6 into the separating chamber 8 of the rotor, in which there is arranged a set of conical discs 9. Solid particles having been separated from the mixture supplied to the rotor are collected at 10 in the separating chamber 8. For intermittent discharge of the separated solid particles during operation of the centrifugal separator the rotor has a number of peripheral openings 11. A valve plate 12 forming the bottom of the separating chamber 8 is arranged to uncover and close these openings. The valve plate 12 is operable in a known manner by means of a liquid supplied to the underneath side of it through supply means 13. When liquid is supplied to a chamber 14 between the lower part 1 of the rotor and said valve plate 12, the valve plate 12 is maintained in its upper position in which it is pressed against the upper part 2 of the rotor. Through a few throttled openings 15 in the rotor part 1 liquid flows out of the chamber 14. When the supply of liquid into the chamber 14 is interrupted, it is emptied of liquid through the openings 15, the valve plate being pressed downwards by the liquid pressure within the separating chamber 8, so that the openings 11 are uncovered. When the liquid flow to the chamber 14 is resumed, the valve plate 12 is again pressed upwards, so that the openings 11 are closed.

Light liquid component separated from the mixture supplied to the rotor leaves the separating chamber 8 through a centrally situated overflow outlet 16 and then flows into a chamber 17. By means of a pairing disc 18 arranged within this chamber the separated liquid component is further pumped out through an outlet conduit 19.

From the radially seen outer part of the rotor separating chamber 8 a channel 20 extends inwards towards the centre of the rotor to a chamber 21. Within the chamber 21 there is a pairing disc 22 arranged to pump liquid from the chamber out through a conduit 23, which thus is constituting a continuation of the channel 20. Liquid flowing through the channel 20 passes on its way into the chamber 21 through one or a few small holes 24 in an annular flange 25 operating as a dam.

Between the above mentioned channel 20 and the rotor separating chamber 8 there is extending a conical partition 26 having one or a few small holes 27. The throughflow capacity of the hole, or the holes together, is substantially less than that of the channel 20.

The outlet conduit 19 for separated light liquid component extends through an equipment 28 comprising means for continuous analysis of the flow through the conduit 19. Said means is arranged to sense when there are beginning to appear in the light liquid component fractions of heavy component which have not been separated in the rotor. When a certain content of such heavy liquid component is sensed with the light liquid component, this indicates that the interface layer within the separating chamber 8 between the separated liquid components have moved radially inwards to a certain level. This level has been shown in the drawing by means of a dash-dot line 21. Another dash-dot line 30 shows a second level radially outside the level 29 but radially inside the opening of the channel 20 in the separating chamber 8.

The above mentioned equipment 28 may for instance comprise an electrical capacitor, between the electrodes of which the flow through the conduit 19, or part of this flow, is allowed to pass. A change of the dielectric constant of the flowing liquid may be sensed in this manner.

In the outlet conduit 23 for heavy liquid component there is arranged a shut-off valve 31, which is normally closed but which is arranged to open during periods of time having a predetermined length.

By means of signal lines 32 and 33 the sensing equipment 28 and the valve 31, respectively, are connected to a control unit 34. This control unit comprises time control means arranged upon a signal from the sensing equipment 28, that the said interface layer within the rotor is situated at the level 29, to give away a signal to the valve 31 such that this will open for flow through the conduit 23 during a predetermined period of time, so that said interface layer will move radially outwards to the level 30.

The centrifugal separator shown in the drawing operates in the following manner.

After the so called operating liquid has been supplied to the chamber 14 within the rotor and, thereby, the slide plate 12 has been brought to abutment against the rotor part 2, the separating chamber 8 is supplied with a mixture of two liquid components and solid particles. In this situation the valve 31 is closed.

After some time of operation there is formed in the radially outer part of the separating chamber an interface layer between separated light liquid component and separated heavy liquid component. In this situation the channel 20 and the chamber 21 are filled with light liquid component. Since the valve 31 in the outlet conduit 23 is closed, the pairing disc 22 can not pump light liquid component out of the chamber 21, however. Simultaneously, separated light liquid component is continuously discharged over the overflow outlet 16 to the chamber 17, from where it is pumped further on by the pairing member 18 through the conduit 19 and the sensing equipment 28.

As heavy liquid component is separated in the separating chamber 8, the interface layer is moving radially inwards. When the interface layer has passed the opening of the channel 20 in the separating chamber 8 and continues radially inwards, light liquid component present in the radially outermost part of the channel 20 is displaced. Thereby a flow of light liquid component is created through the hole 27 from the channel 20 to the separating chamber 8.

When the interface layer has reached the level 29, which is situated close to the radially outermost edges of the separating discs 9, fractions of heavy liquid component are beginning to be entrained by the light liquid component flowing through the interspaces between the separating discs 9 and leaving the rotor through the conduit 19. This is immediately sensed by the equipment 28, from which a signal is given off to the control unit 34, when the content of heavy liquid component in the flow through the conduit 19 has reached a certain valve.

In the control unit 34 a delay mechanism is activated by the signal from the equipment 28, and simultaneously a signal is emitted to the valve 31, which thereby opens for flow through the conduit 23. The pairing member 22 then is brought into operation so that liquid is pumped out of the chamber 21. At the beginning this liquid is constituted by light liquid component present in the chamber 21 and the radially innermost part of the channel 20, but when this limited amount of light liquid component has been pumped out, heavy liquid component will flow off from the separating chamber 8 through the channel 20, the hole 24 and the chamber 21 out through the outlet conduit 23. As a result the interface layer between the separated liquid components in the separating chamber 8 will move radially outwards.

A predetermined period of time after the delay mechanism in the control unit 34 has been activated, the valve 31 is again brought to closing position, so that the outflow of heavy liquid component from the separating chamber ceases. The predetermined period of time is calculated with regard to, among other things, the throughflow area of the hole 24, such that the interface layer in the separating chamber will be situated at the level 30 when the valve 31 is being closed.

As soon as the valve 31 has been closed and the flow of heavy liquid component through the channel 20 has ceased, an equalization is started of the pressures on both sides of the conical partition 26. This occurs in a way such that the heavy liquid component present in the channel 20 will flow radially outwards through the opening of the channel 20 to the separating chamber 8, while light liquid component will flow from the separating chamber 8 through the hole 27 into the channel 20. The interface layer between light heavy liquid component in the channel 20 will set at substantially the same level as the corresponding interface layer in the separating chamber 8, i.e. substantially at the level 30.

The separating operation is then continued until the interface layer has again moved radially inwards to the level 29, after which the above described course is repeated. This may occur several times before it is time to open the peripheral outlets 11 of the rotor for discharge of solid particles separated in the separating chamber. Opening of the peripheral outlets 11 may be initiated either by a timer or by special means for sensing of the amount of solid particles collected in the separating chamber 8.

In a preferred embodiment of the invention a timer is arranged to cooperate with the control unit 34 in the following manner: If the sensing equipment 28 indicates the predetermined content of heavy liquid component in the liquid flowing through the conduit 19 within a predetermined period of time, e.g. 15 minutes, after the last occasion when the periphery outlets 11 were open, then the valve 31 is opened for discharge of heavy liquid component through the conduit 23. After said predetermined period of time has lapsed, the periphery outlets 11 will be opened as soon as the sensing equipment 28 indicates the predetermined content of heavy liquid component of the liquid flowing through the conduit 19.

When the peripheral outlets 11 have again been closed, the above described course is repeated from the beginning of the separating operation.

Only one embodiment of the present invention has been described above. Within the scope of the subsequent claims several other embodiments will fall. For instance the opening and closing movements of the valve 31 may be controlled in any suitable manner. Thus, the opening movement as well as the closing movement may be controlled by guidance of sensing the various positions of the interface layer, for instance by use of the sensing method described in the initially mentioned Swedish Pat. No. 348.121. Further, the connection 27 between the channel 20 and the separating chamber 8 may be arranged in any other suitable way. For instance a hole corresponding to the hole 27 may be present in the radially innermost part of the conical plate 26.

As an alternative to a calibrated hole 24 in a flange 25 may serve for instance a calibrated throttle opening in the conduit 23 or in the valve 31.

In connection with purifying of oil from water it may happen that a water-in-oil emulsion is formed on the way of the oil to or into the centrifugal separator. This results in the formation of an emulsion layer within the separating chamber having a larger or smaller radial extension, which layer constitutes the above mentioned interface layer between separated oil and separated water.

In conventionally operating centrifugal separators it has been difficult during the operation of the rotor to remove such emulsion from the separating chamber. Instead, more and more emulsion has accumulated in the separating chamber, and during the operation of the rotor it has also changed its consistency and become more and more hard. Problems occurring after that have been that fractions of relatively hard emulsion have deteriorated the clean oil leaving the rotor and/or have overflown the edge of the central outlet chamber of the rotor for separated water (since the emulsion has been lighter than the separated water) and deteriorated the outside of the centrifuge rotor.

By sensing the dielectric constant of the liquid flowing through the outlet conduit 19 it is possible to notice at a very early stage that water in the form of a water-in-oil emulsion is beginning to flow through the conduit 19 already before the emulsion has changed its consistency. (The dielectric constant of mineral oil is in the order of 2–4, whereas the dielectric constant of water is about 80). It is thus possible by means of the sensing equipment 28 to indicate the position of the radially innermost part of an emulsion layer formed in the separating chamber and, after that, to discharge through the valve 31 not only separated water but also the emulsion. The emulsion problem which is commonly known in connection with separation of heavy fuel oil by means of a conventional centrifugal separator is thereby avoided by the present invention.

What is claimed is:

1. A centrifugal separator comprising a rotor having a separating chamber and an inlet for supplying said chamber with a mixture of light and heavy liquids, the rotor being operable to form in said chamber an interface layer between separated light and heavy liquids of said mixture, first and second outlet means for discharge of separated light and heavy liquids, respectively, from said separating chamber, said second outlet means including a channel extending radially inward from an inlet opening of the channel located in the radially outer part of the separating chamber, control means for initiating discharge through said second outlet means in response to movement of said interface layer radially inward to an inner level in the separating chamber, said layer moving radially outward when heavy liquid is discharged through said second outlet means, and a control unit responsive to operation of said control means for stopping said discharge through the second outlet means when a desired amount of heavy liquid has left said chamber through said second outlet means.

2. A centrifugal separator comprising a rotor having a separating chamber and an inlet for supplying said chamber with a mixture of light and heavy liquids, the rotor being operable to form in said chamber an interface layer between separated light and heavy liquids of said mixture, first and second outlet means for discharge of separated light and heavy liquids, respectively, from said separating chamber, said second outlet means including a channel extending radially inward from an inlet opening of the channel located in the radially outer part of the separating chamber, control means for initiating dishcarge through said second outlet means in response to movement of said interface layer radially inward to an inner level in the separating chamber, said layer moving radially outward when heavy liquid is discharged through said second outlets means, and a control unit operable to stop said discharge through the second outlet means when the outwardly-moving interface layer reaches an outer level located radially inward of said inlet opening of said channel.

3. The separator of claim 1 or 2, in which said second outlet means includes said channel as a first channel, a central chamber of the rotor into which said first channel leads, and a stationary outlet member having a second channel extending from the central chamber.

4. The separator of claim 3, in which said outlet member is a paring device.

5. The separator of claim 1 or 2, in which said second outlet means includes a valve which is opened by said control means to initiate said discharge through the second outlet means.

6. The separator of claim 16, in which said control unit is operable to close the valve a predetermined period of time after it is opened.

7. The separator of claim 1 or 2, in which said second outlet means includes a calibrated outflow opening dimensioned to provide a predetermined rate of discharge through the second outlet means.

8. The separator of claim 1 or 2, in which the rotor has a separate interconnection between the separating chamber and said channel, said interconnection being located between the ends of said channel and having a smaller throughflow capacity than said channel.

9. The separator of claim 8, comprising also a set of conical separating discs in the separating chamber, said interconnection being located at substantially the same radial distance from the rotor axis as the radially outer edges of said dics.

10. The separator of claim 8, in which said interconnection is located substantially at said inner level in the separating chamber.

11. The separator of claim 1 or 2, in which said control means include a sensor in said first outlet means for sensing the presence of said heavy liquid in the separated light liquid discharging through the first outlet means, said control means being operable to initiate said discharge through the second outlet means in response to said sensing of heavy liquid.

12. The separator of claim 11, in which said sensor is operable to sense a change in the dielectric constant of the liquid flowing through said first outlet means.

13. In the operation of a centrifugal separator having a rotor with a separating chamber and an inlet to said chamber for a mixture of light and heavy liquids to be separated, and first and second outlet means for discharge of separated light and heavy liquids, respectively, from said chamber, said second outlet means including a channel extending radially inward from an inlet opening of the channel located in the radially outer part of the separating chamber, the method which comprises feeding the mixture through said inlet while driving the rotor to maintain in said chamber an interface layer between separated light and heavy liquids and while discharging separated light liquid through said first outlet means, initiating discharge through said second outlet means when said interface layer moves radially inward to a predetermined inner level in the separating chamber, allowing the interface layer to move radially outward during said discharge through the second outlet means when a predetermined amount of heavy liquid has left the separating chamber through the second outlet means.

14. In the operation of a centrifugal separator having a rotor with a separating chamber and an inlet to said chamber for a mixture of light and heavy liquids to be separated, and first and second outlet means for discharge of separated light and heavy liquids, respectively, from said chamber, said second outlet means including a channel extending radially inward from an inlet opening of the channel located in the radially outer part of the separating chamber, the method which comprises feeding the mixture through said inlet while driving the rotor to maintain in said chamber an interface layer between separated light and heavy liquids and while discharging separated light liquid through said first outlet means, initiating discharge through said second outlet means when said interface layer moves radially inward to a predetermined inner level in the separating chamber, allowing the interface layer to move radially outward during said discharge through the second outlet means, and stopping said discharge through the second outlet means when the outwardly moving interface layer reaches an outer level located radially inward of said inlet opening of the channel.

15. The method of claim 13 or 14, in which discharge through said second outlet means is initiated in response to sensing of heavy liquid in the separated light liquid discharging through said first outlet means.

* * * * *

UNITED STATES PATENT AND TRADEMARK OFFICE

CERTIFICATE OF CORRECTION

PATENT NO. : 4,525,155

DATED : June 25, 1985

INVENTOR(S) : Vilgot Nilsson, deceased

It is certified that error appears in the above-identified patent and that said Letters Patent are hereby corrected as shown below:

Col. 5, line 48, "valve" should be--value--.

Col. 8, line 16, "16" should be--5--.

Signed and Sealed this

*Fourth* Day of *March 1986*

[SEAL]

*Attest:*

DONALD J. QUIGG

*Attesting Officer*

*Commissioner of Patents and Trademarks*